US007543400B2

(12) United States Patent
Kramer

(10) Patent No.: US 7,543,400 B2
(45) Date of Patent: Jun. 9, 2009

(54) INLINE CLASSIC SKIING TRACK GLAZING MACHINE

(76) Inventor: Jerry Vernard Kramer, N8642 Hwy A, Watertown, WI (US) 53094

( * ) Notice: Subject to any disclaimer, the term of this patent is extended or adjusted under 35 U.S.C. 154(b) by 107 days.

(21) Appl. No.: 11/129,835

(22) Filed: May 16, 2005

(65) Prior Publication Data

US 2006/0258514 A1 Nov. 16, 2006

(51) Int. Cl.
*E01H 4/00* (2006.01)

(52) U.S. Cl. ..... 37/219; 239/2.2

(58) Field of Classification Search ..... 482/70–71; 37/219–224; 239/2.2
See application file for complete search history.

(56) References Cited

U.S. PATENT DOCUMENTS 3,675,857 A * 7/1972 Bourton ..... 239/668
3,761,020 A * 9/1973 Tropeano et al. ..... 239/2.2
6,793,148 B2 * 9/2004 Ratnik ..... 239/2.2

FOREIGN PATENT DOCUMENTS

EP 19900113229 10/1991
JP 1995031009-F25C3104 5/1997

* cited by examiner

*Primary Examiner*—Fenn C Mathew

(57) ABSTRACT

A machine towed by a snowmobile that forms parallel cross country snow skiing tracks and having a water container mounted thereon, which streams water through two water outlet ports by gravity and assist from the use of an air pump, powered by a storage battery to the bottom portion of the skiing tracks, where the water turns to ice in below freezing temperatures, thus imparting a slippery surface to the tracks, which provides an improved skiing surface that enhances the gliding action for the enjoyment of a skier.

9 Claims, 3 Drawing Sheets

INLINE CLASSIC SKIING TRACK GLAZING MACHINE

CROSS REFERENCE TO RELATED APPLICATIONS not applicable

FEDERAL SPONSORED RESEARCH not applicable

SEQUENCE LISTING OR PROGRAM not applicable

BACKGROUND OF THE INVENTION

1. The Subject Matter of the Claimed Invention

This invention relates to inline classic snow skiing, especially to the skiing tracks, the machine that forms them, and a method to cause the tracks to be glazed with ice.

2. Background of the Invention

Cross country classic style skiing is a fun and healthy sport Skiing on a good set of inline tracks that are slightly icy, is very enjoyable. The problem with regular skiing tracks is that you have to use a variety of ski waxes, depending on temperatures, clouds, sunshine, time of day etc., with the correct amount of ice glaze in the tracks, the need for ski waxing is almost eliminated.

There are track setters I am aware of, but none that I know of that glaze the skiing tracks. As shown in Silent Sports Magazine, www.silentsports.net vol. 20 no. 5 Nov. 2003 issue, Pisten Bully, page 20, Yellowstone Track Systems, page 23, Tidd Tech Ltd., page 24, and Trakor of Harbor Springs, Mich., page 21, all set tracks, but most are very heavy machines, and obviously expensive to manufacture, and more than not, hard to tow, My track glazing machine is easy to build, light weight, and easy to tow.

OBJECTS AND ADVANTAGES (a) to provide a machine to contain a glazing device;

(b) to provide a glazing device that is compatable with machine;

(c) to provide a snow skiing track that has a unique surface which reduces ski waxing;

(d) To provide a way to limit the use of ski wax, primarily glide wax;

(e) To provide a way to make classic style skiing more enjoyable;

SUMMARY

A machine that forms a pair of snow skiing tracks, and glazes them with ice, to enhance ski gliding action. This is accomplished by an onboard water container, which flows the liquid by gravity and assist from a small air pump powered by a twelve volt utility battery, the liquid freezes, which improves the glide action for the skier.

DRAWINGS

Figures

DRAWINGS

Reference Numerals

54 Initial track makers

52 Valley manufactured ball coupler

50 spring steel crust cutters

Figure 1:
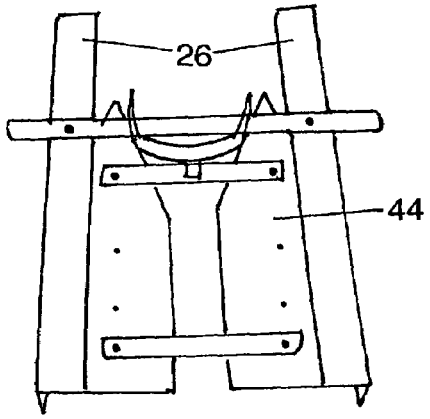
FIG. 1 shows the top side of groomer shoes, tracking guides, and cross brackets.
Figure 2:
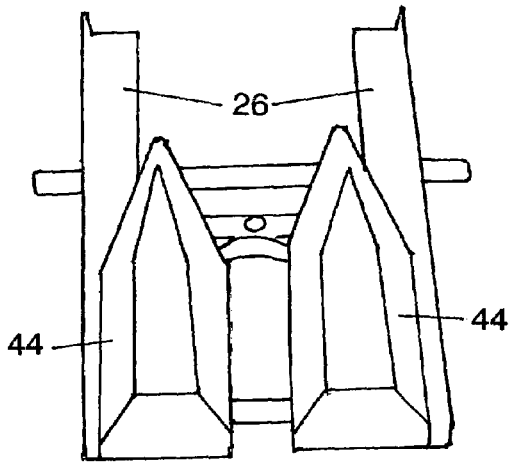
FIG. 2 shows the bottom side of groomer shoes, tracking guides, and brackets.

| Photograph—Reference numerals | |
|---|---|
| 48 | water container |
| 46 | dampening spring |
| 44 | groomer shoes |
| 42 | cross member |
| 40 | hook bolt, coil spring, and adjuster knob |
| 38 | rear springs |
| 36 | brackets |
| 34 | weight package |
| 32 | air pump |
| 30 | battery |
| 28 | battery support brackets |
| 26 | tracking guides |
| 24 | air vent |
| 22 | air valve |
| 20 | drop tube |
| 18 | tee fitting |
| 16 | water jets |
| 14 | plastic snow shield |

DETAILED DESCRIPTION

Figure 4:
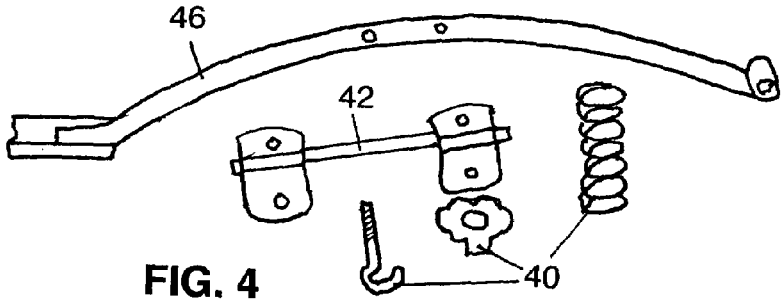
FIG. 4 shows the upper mounting brackets and the cross member, the hook bolt, spring, adjuster bolt, and the dampening spring.
Figure 5:
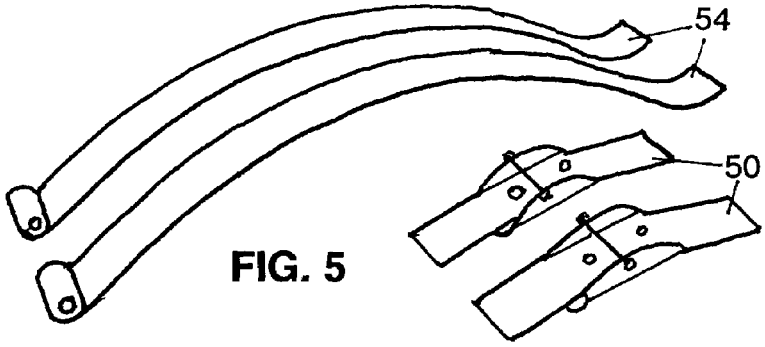
FIG. 5 shows the initial track makers, and their ice cutters.

I accomplish this by the use of four curved leaf springs, spring steel is very strong and flexible. The front two springs, which are the initial track makers 54 (FIG. 5) attach to the tow machine by a Valley manufactured ball coupler 52, these springs have steel ice cutters 50 (FIG. 5) on there lower portions. Also attached to the ball coupler is a dampening spring 46 (FIG. 4), which supplies down pressure to the groomer shoes 44 (FIG. 1) from this spring to a cross member 42 (FIG. 4) on the front springs is a hook bolt, coil spring, and a adjuster knob 40 (FIG. 4), when the knob is turned it controls the depth at which the initial track makers 54 cut through the snow.

Figure 3:
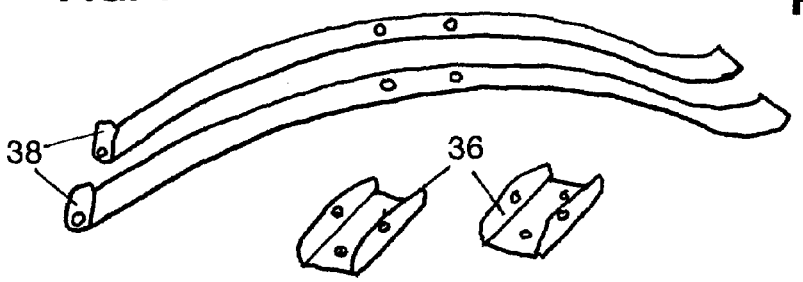
FIG. 3 shows the two rear springs and their mounting brackets that fasten to the groomer shoes.
Figure 8:
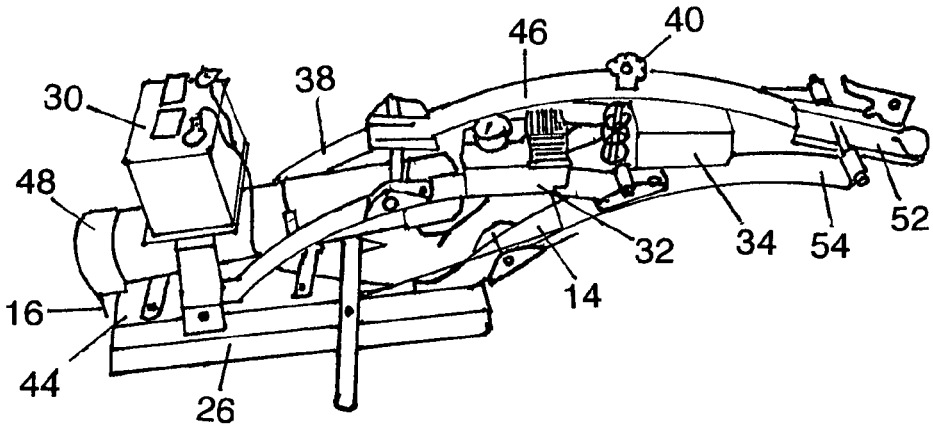
FIG. 8 shows the machine assembled with air pump, battery, and Plastic snow shield.
Figure 9:
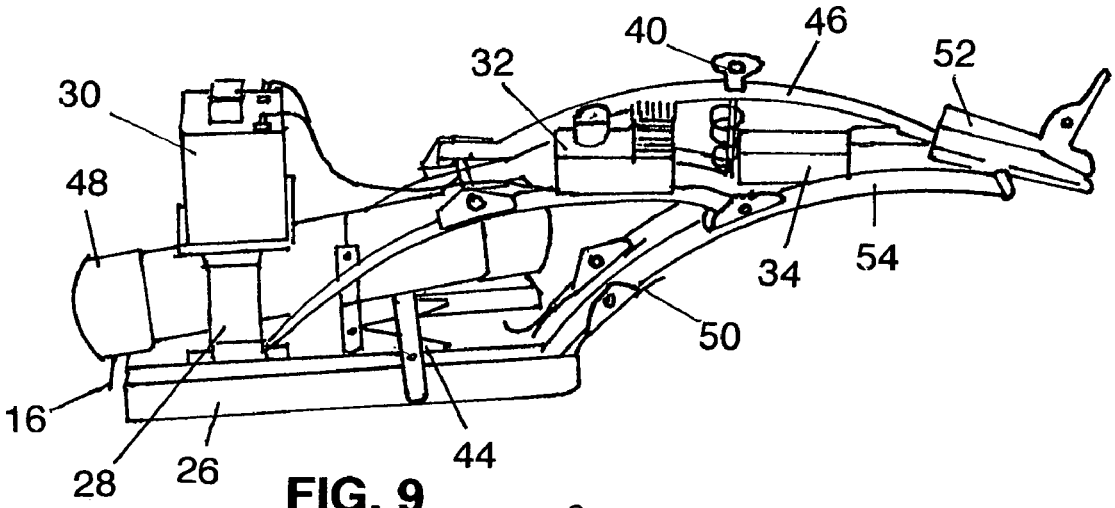
FIG. 9 shows right side full view.
Figure 10:
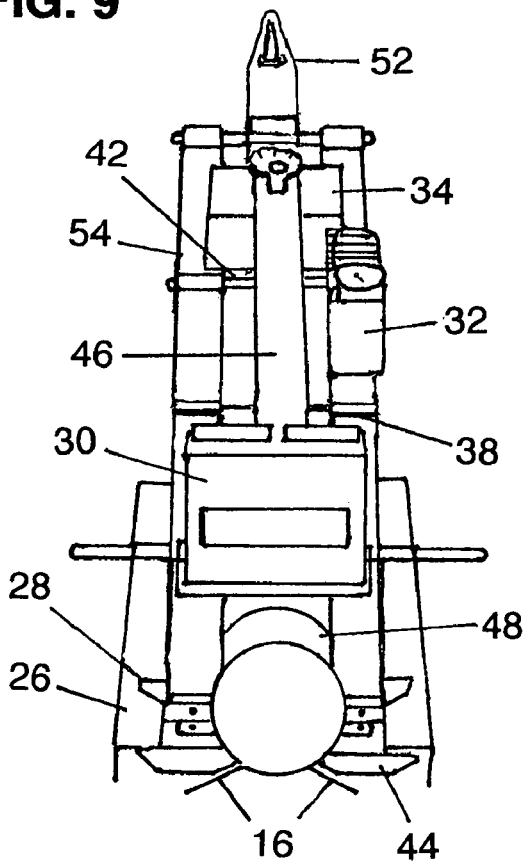
FIG. 10 shows the rear top view.

Two rear springs 38 (FIG. 3) are mounted to the front springs by brackets 36 (FIG. 3), at this location a twenty pound weight package 34 (FIG. 8) is placed. It supplies down pressure to the track makers. An air pump 32 (FIG. 8) is located near this weight package. A PVC pipe water container 48 (FIG. 6) is centered between the rear springs and the battery support brackets 28 (FIG. 8). Positioning the battery in this location supplies down force to the groomer shoes, and the tracking guides 26 (fig) 1.

DETAILED DESCRIPTION

These tracking guides, which are on the left and right side of the groomer shoes, keep the skiing tracks in alignment through the snow. A "high strength plastic snow shield" 14 (FIG. 8) fits into the groomer shoe brackets for snow blending.

Figure 6:
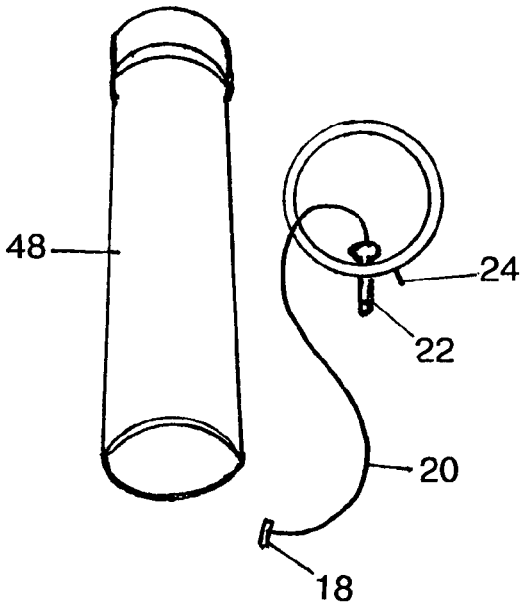
FIG. 6 shows the PVC water container, the removable end cap, the drop tube with tee fitting, air vent, and the air valve.
Figure 7:
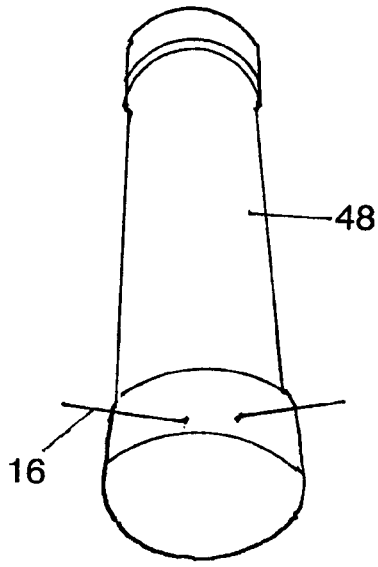
FIG. 7 shows the water dispensing outlet ports and PVC water container.

PVC pipe material is used for the water container 48, it contains an air vent 24, an air valve 22, a drop tube 20 with a tee fitting 18 on its end, and two water dispensing outlet ports 16. (FIG. 6). When air is pumped into the water container, pressure builds, causing the water to agitate, which thwarts against freeze up, and causes water to flow at a calibrated rate of flow from the water dispensing outlet ports to the center of the tracks, whereby track glazing occurs.

As stated in the description above, water is the liquid of choice for the track glazing. but any liquid that imparts a slippery surface to the tracks can be used. The size and shape of the water container can be altered. A twelve volt battery operated heater element can be introduced to the water container to prevent freezing of the water, as well as heat conducting water dispensing outlet ports, serviced by miniature heading cables, can be used if necessary in extremely cold temperatures.

My track glazing machine is designed to be used with or without the water container glazing device. This device can be removed in thirty seconds and a twenty five pound weight package slips into its place. This weight supplies down pressure on the groomer shoes, down pressure on the these shoes is necessary to form good clean tracks, when the weight package is not used, this pressure is supplied by the water container and the battery.

I claim:

1. A towable apparatus for inducing a slippery surface to snow tracks, comprising:

(a) said apparatus having a frame assemblage of arcuated springs, said springs identically paired, wherein frontward springs couple to a towing attachment, rearward springs couple to snow track grooming shoes, said frame assemblage further coupled by horizontal shafts in a tandem trailing configuration, and (b) said frame assemblage having a water supply container, said container having an elongated cylindrical shape, centrally mounted, cradling between said rearward and said forward springs, and (c) a pump means disposed thereon to said frame assemblage for assisting water dispensing in company with gravity, from two water container outlet ports, to said tracks.

2. The apparatus of claim 1, further comprising: said two frontward springs form first snow track grooves, trailed by said grooming shoes, further including a fifth incurvate spring centrally located, as a dampening means for said frame assemblage.

3. The apparatus of claim 2, further including: wherein said snow track grooming shoes having sloping sides and flat bottoms.

4. The apparatus of claim 2, further including: wherein said grooming shoes having side ached tracking guides as means to sustain straight line track forming.

5. The apparatus of claim 1, further comprising: said water container having a predetermined size arid capacity, and an incline plane upwards, with sealed end caps, wherein two water dispensing outlet ports of predetermined size and length extend from lower end cap on said water container to bottom portion of said tracks.

6. The apparatus of claim 1, further including: a weight of predetermined mass disposed on said forward springs as a down force compression means to said frame assemblage.

7. The apparatus of claim 1, further comprising: a battery disposed on said frame assemblage, inducing track forming compression and a power means for said air pressure pump coupled to said water container, wherein water is dispensed by gravity and pump assist to said tracks.

8. The apparatus of claim 1, further including: wherein said apparatus attains said slippery snow tracks by dispensing water in a freezing environment while being towed.

9. The apparatus of claim 8, further including: wherein said snow tracks being of those utilized by an intrack skiing person.

* * * * *